United States Patent [19]

Forbes, Jr. et al.

[11] 4,053,050

[45] Oct. 11, 1977

[54] DISPLAY PACKAGE

[75] Inventors: Hampton E. Forbes, Jr., Wilmington; John M. Nock, New Castle, both of Del.

[73] Assignee: Westvaco Corporation, New York, N.Y.

[21] Appl. No.: 718,073

[22] Filed: Aug. 26, 1976

[51] Int. Cl.[2] ..... B65D 75/04; B65D 85/20

[52] U.S. Cl. ..... 206/361; 206/362.4; 206/472; 206/475; 206/476; 206/806

[58] Field of Search ..... 206/45.14, 45.31, 45.34, 206/361, 362.4, 362.2, 380, 443, 472, 475–476, 491, 525, 806; 229/8, 16 D, 40, 87 R

[56] References Cited

U.S. PATENT DOCUMENTS

| | | | |
|---|---|---|---|
| 2,295,242 | 9/1942 | Slingsby | 206/380 |
| 2,343,715 | 3/1944 | Taylor | 206/45.31 |
| 2,491,423 | 12/1949 | Snyder | 206/463 X |
| 2,727,620 | 12/1955 | Buttery | 206/45.31 X |
| 2,981,405 | 4/1961 | Grasty | 206/491 |
| 3,077,978 | 2/1963 | Krzyzanowski et al. | 206/362.4 |
| 3,315,931 | 4/1967 | Puckett | 206/45.14 X |
| 3,416,656 | 12/1968 | Addiego | 206/461 |
| 3,495,699 | 2/1970 | Giesler | 206/45.31 X |

*Primary Examiner*—Steven E. Lipman

[57] ABSTRACT

A display package for elongated products is prepared from a single rectangular blank of paperboard or the like that is folded about a centrally located score line and suspended on a display panel from a rod-like member which extends through an opening provided at the top of the package. The blank from which the display package is formed has a longitudinal dimension greater than its width dimension and includes, in addition to its centrally located score line, a plurality of cuts and secondary scores which together form a product enclosing and retaining intermediate panel and a pair of spaced apart upper and lower apertures of which one or both may be covered with a transparent film to provide a window or windows in the package.

8 Claims, 6 Drawing Figures

DISPLAY PACKAGE

BACKGROUND OF INVENTION

The present invention relates in general to display packages and more particularly to a display package useful for point-of-purchase displays.

Display packages of the type disclosed herein are well known in the art and are generally formed from a combination of paperboard and plastic materials such as blister packs, shrink film wrappers or folded cartons. In each case, the packages normally include an opening in a portion thereof which enables the packaged products to be displayed on a display panel from pins or rod-like members mounted on the display panel. In this manner the packaged products are made available in separate units against a display background which can contain artwork and other graphics to enhance retail sales. In addition, the separate units serve as protection during shipment and deter pilferage when displayed.

Some of the requirements for such display packages include the ability to show the product attractively, economical construction and ease of product loading with a minimum of equipment and expense. In the case of the present invention, each of the above features are achieved since the package is constructed from a single blank of relatively inexpensive paperboard and it is formed and loaded easily and without expensive equipment.

DESCRIPTION OF PRIOR ART

The following list of U.S. Pat. Nos. are believed to illustrate exemplary designs for display packages constructed and used substantially like the package disclosed herein: 2,134,846, 3,161,288, 2,343,715, 3,416,656, 2,491,423, 3,497,059, 2,831,573.

The display packages disclosed in the above noted patents demonstrate the variety of different designs available for point-of-purchase displays. However, a careful consideration of the above noted designs will demonstrate that as compared with the simple and effective package disclosed herein, the prior art packages are expensive, difficult and costly to use, require complex machinery, heat or other efforts to fill and seal, and generally do not provide the sales appeal generated by the package of the present invention.

SUMMARY OF INVENTION

The display package of the present invention is prepared from a one-piece cut and scored paperboard blank in the form of a simple wrapper. The construction is easy to set up and seal for use requiring only one fold and one glue application. The blank itself is generally rectangular in shape with a longitudinal dimension greater than its width dimension. A centrally located score line is provided in the blank along its longitudinal dimension which bisects the blank into two equally sized portions, and, about which the blank is folded to enclose a product. The improvement in the display package herein lies in the development with cuts and scores of a product retaining and enclosing intermediate panel flanked by a pair of upper and lower apertures all wholly located within the perimeter of the blank. The intermediate panel is preferably scored so as to wrap around and generally hold the product in the single fold of the wrapper while the apertures serve to display the product while leaving one or more portions of the product exposed for examination by the consumer. In some cases, both apertures on the blank are covered with a transparent film material to provide two windows in the wrapper, but generally, only one aperture is applied with film while the other aperture remains open as described above.

Depending upon the article packaged, the transparent film can be replaced with a heat shrink film or the like as well known in the art. Similarly, as readily appreciated by those skilled in the art, the blank is also adaptable to both cold or heat set adhesives for sealing. In the situation where the package is loaded and sealed by the customer, the package is shipped in a flat condition from the manufacturer either with or without the window material applied. Where the blank is shipped in its folded and sealed condition, one aperture must remain open for loading the package.

Accordingly it may be seen that the display package of the present invention provides an economical and simple wrapper type structure that can be printed with universal graphics and still be used to package an entire line of products which differ from item to item. This result is accomplished with the addition of the window to the package which enables the purchaser to see the product displayed for sale. Moreover, by providing a second aperture in the blank, a portion of the product is also exposed for examination by the consumer. This latter feature is particularly desirable for marketing certain types of products. In this regard, one of the embodiments of the present invention was designed particularly for use in the point-of-purchase display and sale of artists paint brushes. The paint brushes are merchandised in a variety of styles, shapes and sizes. In each case, the manufacturers name and number designation for the brush are each printed on the handle. Thus, in order to provide a universal package for a complete line of brushes without the necessity of overprinting the package for the particular brush packaged therein, the window of the package solves the problem by allowing the consumer to readily see what he or she is buying. Moreover, since an artist rarely purchases a paint brush without first determining its texture with his or her sense of touch, the aperture in the package allows the artist to touch the bristles before purchase.

DETAILED DESCRIPTION

Figure 1:
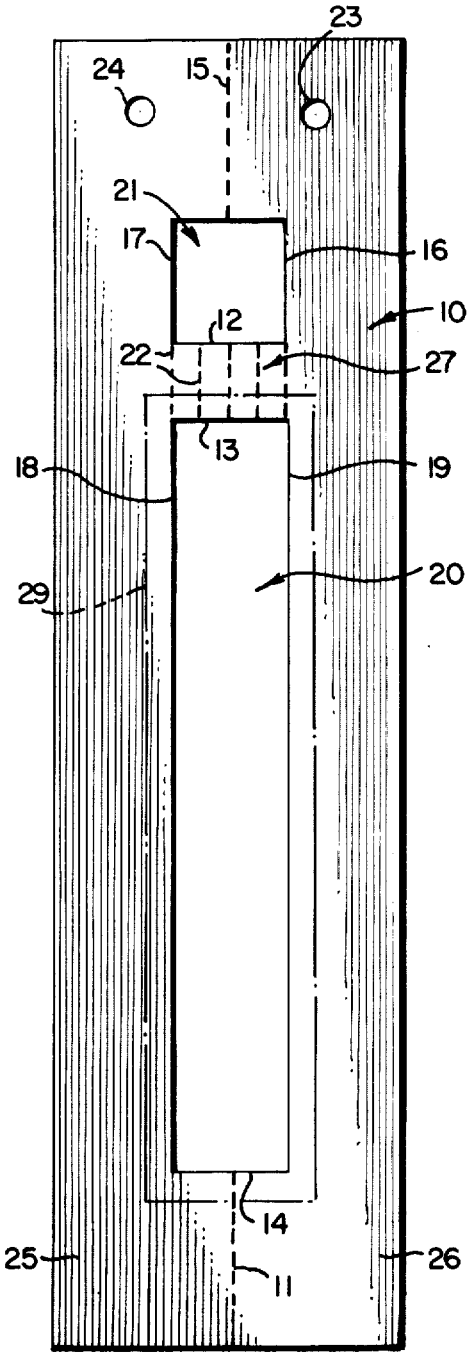
FIG. 1 is a plan view of a typical flat paperboard blank from which the display package of the present is constructed.

Referring now to the drawing in detail, and more particularly to FIG. 1, there is illustrated a flat blank 10 of paperboard material that is cut and scored to form the different elements and features of the display package of the present invention. Blank 10 may be seen to be substantially rectangular in shape with its longitudinal dimension greater than its width dimension. The blank is bisected along its longitudinal dimension by a centrally located score line 11 which divides the blank into two portions 25,26. Each portion 25,26 contains openings 24,23 near the top thereof which line up with one another when the blank is folded about fold line 11 to form the package shown in FIG. 2. Accordingly, as shown in FIG. 2, the package is folded, filled and sealed and in condition for display on a suitable display board.

The blank further contains an intermediate product retaining and enclosing panel 27 and a pair of upper and lower apertures 21,20 all wholly located within the perimeter of the blank. Intermediate panel 27 is formed by a pair of cut lines 12,13 which are spaced apart along the longitudinal dimension of the blank and which together define the length of panel 27. In addition, intermediate panel 27 also is preferably scored as shown at 22 along the longitudinal dimension of the blank to provide the product enclosing and retaining function and to accomodate products of different size. Cut lines 12,13 may be parallel to one another as shown in FIG. 1 or otherwise, but in any event, the lines 12,13 each extend equidistant on each side of the central score 11 when a substantially rectangular intermediate panel 27 is desired. Apertures 21,20 are formed by additional cut lines 15,16,17 and 14,18,19 applied to the blank. For instance, upper aperture 21 is formed by cut line 15 located outboard of and parallel to cut line 12, and, a pair of perpendicular cut lines 16,17 which connect with the ends of cut lines 12,15. Meanwhile, lower aperture 20 is formed by cut line 14 located outboard of and parallel to cut line 13, and, a second pair of perpendicular cut lines 18,19 which connect with the ends of cut lines 13,14. Thus, in the case of the blank of FIG. 1, the upper aperture 21 is substantially square in shape and located centrally of the blank in the width dimension while lower aperture 20 is substantially rectangular in shape and similarly located in the blank. For the purpose of the present invention, cut lines 12 and 13 are considered a first pair of cut lines and cut lines 15,16,17 and 14,18,19 together are considered a second pair of cut lines. Finally, lower aperture 20 is also shown as being covered by a piece of film material 29 that may be selected from the class of materials that are transparent and readily bondable to paperboard. Among this class are cellophane, polyolefins and polymeric materials including those capable of being shrunk with heat, heat sealed or simply glued to the paperboard.

Figure 2:
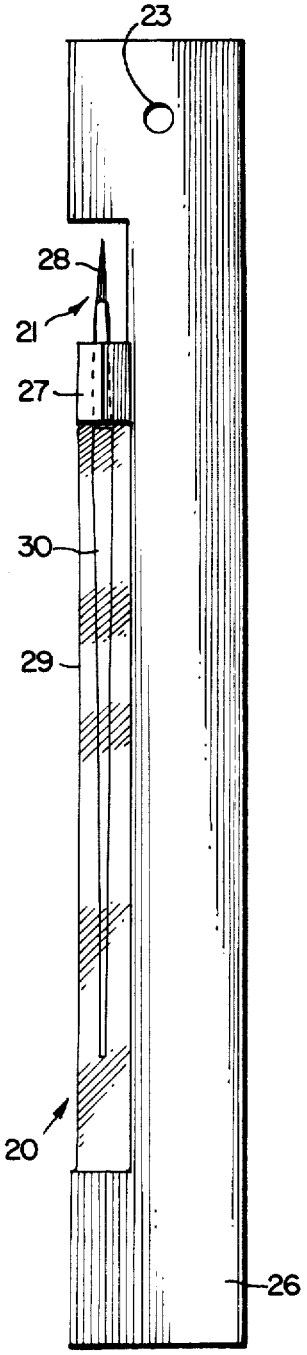
FIG. 2 is a side view of the blank of FIG. 1 in the folded and sealed condition showing an artists paint brush in the package with film material applied to the lower aperture.

FIG. 2 shows the blank of FIG. 1 folded about central score 11 and sealed to enclose a typical artists paint brush 30. As noted hereinbefore, the product, such as paint brush 30, may be placed on the blank before the blank is folded and glued, or, the blank can be folded, glued and then the upper part of the blank moved aside to load the brush through aperture 21. In either case, the brush is retained in the package by intermediate panel 27 which is preferably scored to accomodate the thickness of the product. Meanwhile, the transparent window 29 permits the prospective purchaser to examine the product and determine its designation, size, etc., and the open aperture 21 allows the prospective purchaser to touch the bristles 28 and determine their texture.

Figure 3:
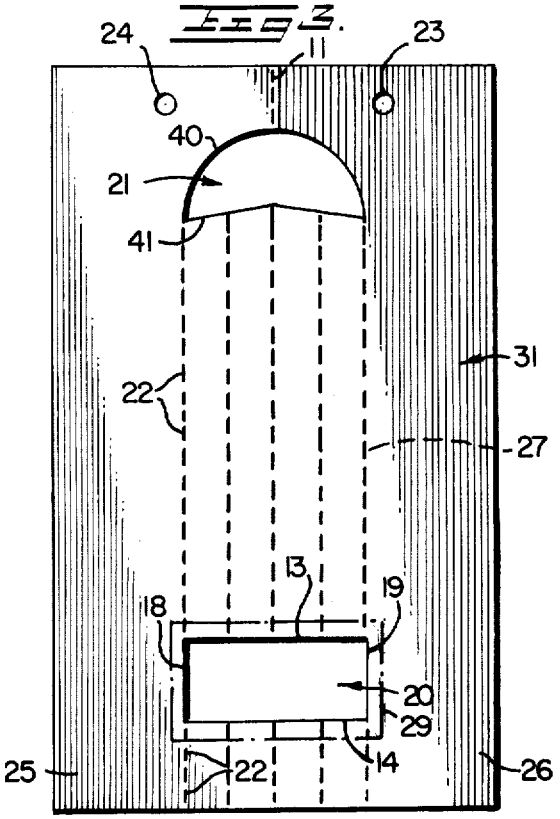
FIG. 3 is a plan view of a modified blank for use in the present invention.

FIG. 3 shows a second embodiment of the present invention wherein blank 31 includes upper and lower apertures 21,20 and an intermediate panel 27 substantially larger than the same panel in FIG. 1. The blank 31 and package formed from the blank is designed to accomodate products that are larger than those contemplated for the package shown in FIG. 2 and that require more strength and protection. For this purpose, panel 27 in FIG. 3, defined by cut lines 13 and 41, has a length greater than panel 27 of FIG 1. In addition, it will be noted that the intermediate panel scores 22 have been continued into the lower portion of the blank outboard of aperture 20 so as to accomodate a product that might extend below the lower aperture 20 of blank 31. Meanwhile, cut lines 13 and 41 are illustrated as not parallel but they each extend on either side of central score 11 an equal distance to produce a substantially rectangular intermediate panel. The second pair of cut lines in blank 31 are comprised of cut line 40 and cut lines 14,18,19 together, as was the case in FIG. 1. Thus, two apertures 21,20 are provided in blank 31 having a different shape and size while the lower aperture is illustrated as being covered with film material 29 to provide a lower window. Moreover, as in the case of the FIG. 1 embodiment, cut lines 13 and 41 are designated a first pair of cut lines and cut lines 40 and 14,18 and 19 together are designated a second pair of cut lines.

Figure 4:
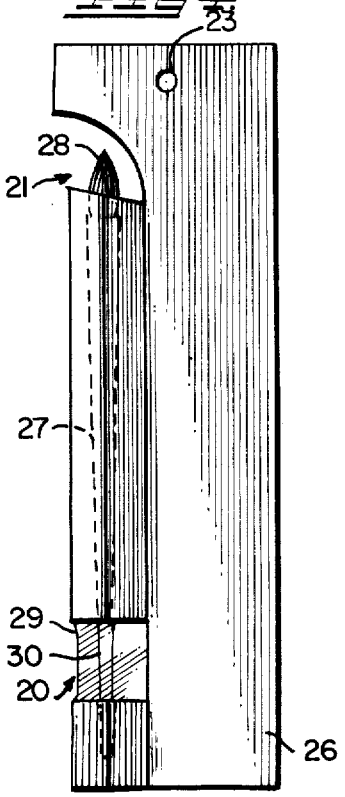
FIG. 4 is a side view of the package formed from the blank of FIG. 3.

In FIG. 4, the two halves 25,26 of blank 31 are shown as being folded over to enclose a fairly large paint brush 30. Window 29 is included to expose sufficient information on the handle of the brush to provide product identification while upper aperture 21 remains open to expose the bristle portion 28. It should be understood however, that the embodiment of the invention shown in FIGS. 3 and 4 along with the other embodiments are capable of use for packaging products other than paint brushes. Primarily, the package of the present invention could be used to package just about any elongated product for display on a suitable display panel. In each of the embodiments shown, the lower aperture is illustrated as being covered with a piece of transparent film material while the upper aperture is left open to expose a portion of the product. This is the preferred embodiment. However, one skilled in the art could readily apply film to both apertures where desirable or could leave both apertures open depending upon the type of product being packaged.

Figure 5:
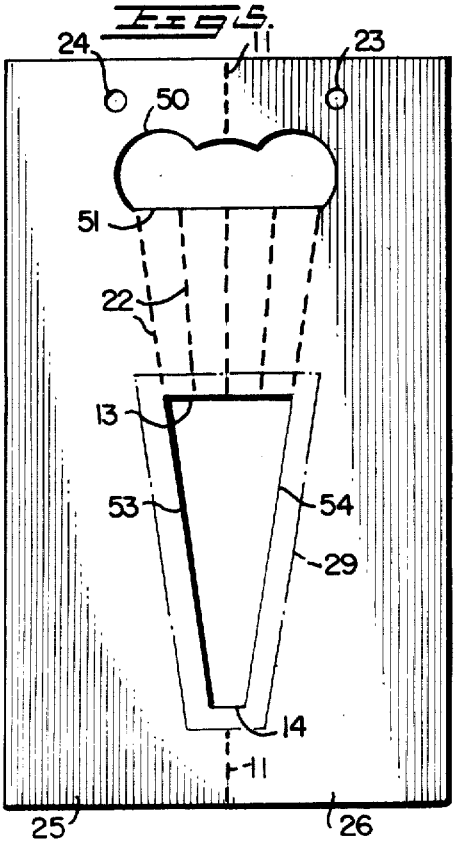
FIG. 5 is a plan view of a second modified blank for use in the present invention; and, FIG. 6 is a side view of the package formed from the blank of FIG. 5.
Figure 6:
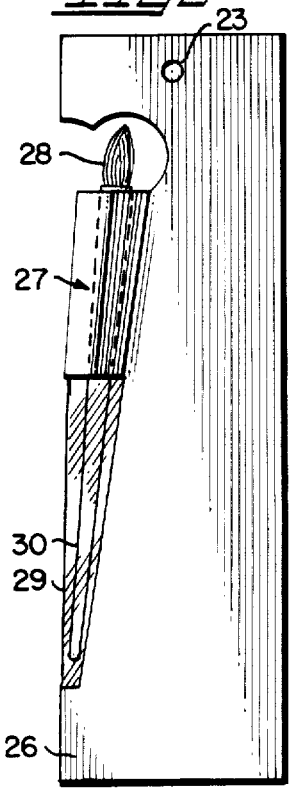

FIG. 5 illustrates a third embodiment of the present invention wherein the blank is provided with yet another shape for the upper aperture 21 and an intermediate panel 27 of trapezoidal configuration. Panel 27 in FIG. 5 is formed by cut lines 13 and 51 each of which are parallel but as shown, they do not extend equidistant on either side of central score 11. Accordingly, the panel 27 of FIG. 5 takes the form of a trapezoid and the scored lines 22 in panel 27 follow the taper of the nonparallel sides of the trapezoid on each side of central score 11 while remaining substantially parallel to one another. Lower aperture 20 is formed by cut lines 14,53 and 54 together and cut line 13, and it also follows the general shape of trapezoidal panel 27. A piece of transparent film material 29 is applied to the blank aperture 20 to form the lower window of the blank. Meanwhile, upper aperture 21 is formed by cut line 51 and the arcuate cut line 50. Each of these cut lines are symmetrically oriented with respect to central score 11 but are not of equal length so that when the blank is folded as shown in FIG. 6, the aperture formed becomes fanciful in shape. The fanciful shape is desirable in those cases where added sales appeal is needed for merchandising the product. As before, the product packaged in the folder shown in FIG. 6 is exposed at 28 in upper aperture 21 while the lower window 20 illustrates enough of the product so that additional product identification is not required on the outside of the package. Further as in the case of the two prior embodiments cut lines 13 and 51 are designated a first of cut lines and cut lines 50 and 14,53,54 together are designated a second pair of cut lines.

In each of the embodiments of the present invention, the two portions of the blank 25,26 are adhered to one another so as to lie in face-to-face contact in all areas outside of the scored intermediate panel 27. Thus when the product is enclosed by panel 27, the distortion of the panel material along score lines 22 tends to grip and retain the product therein and also locate the product within the package away from the open edge of the folded blank. This advantageous orientation of the product is desirable to prevent the product of one package from hanging up on the package for another product as they are stored or removed from the display panel pins. In each case, the location, weight and size of the packaged product must be taken into account when the openings 23,24 are punched in the blank to insure that the package remains substantially vertical when placed on the display panel. However, it will be recognized by one skilled in the art that the above, including other modifications, changes and alterations to the package could readily be made within the scope of the appended claims.

We claim:

1. A substantially flat display package for elongated products prepared from a one-piece blank of paperboard or the like and formed from a blank of material having a longitudinal dimension greater than its width dimension, said blank including a centrally located score line along its longitudinal dimension which bisects the blank into two equally sized portions and about which the two equally sized portions are folded into face-to-face contact to enclose a product, the improvement comprising a pair of spaced apart apertures wherein at least one of said apertures is covered with a piece of transparent film material to form a window in said blank and an intermediate means formed from said blank material which separates the window from said remaining aperture for enclosing and retaining a portion of said product, said intermediate means comprising:

a. a symmetrical panel formed by a first pair of cut lines in said blank, said cut lines being spaced apart along the longitudinal dimension of said blank to define the length of said panel;

b. a plurality of secondary score lines in said panel along the longitudinal dimension of said blank wherein said secondary score lines include at least one pair which connect the ends of said first pair of cut lines and a plurality of additional score lines between said pair that are spaced from one another; and, c. a second pair of cut lines in said blank spaced outboard of said first pair of cut lines and which connect with the ends of said first cut lines to define with said first cut lines the spaced apart window and remaining aperture in said blank said remaining aperture exposing a first part of a packaged product for physical examination by a consumer while the window exposes another part of the packaged product to the view of a consumer.

2. The display package of claim 1 wherein said first pair of cut lines are of equal length and extend an equal distance on each side of said centrally located score line to form a panel of substantially rectangular configuration.

3. The display package of claim 2 wherein each of said second pair of cut lines include first portions that are parallel to and of equal length with said first pair of score lines and second portions that are perpendicular to said first portions and said first pair of score lines.

4. The display package of claim 3 wherein said window and aperture are of substantially rectangular shape, of different length and about the same width.

5. The display package of claim 1 wherein said secondary score lines extend into the portion of said blank below the window portion of said blank.

6. The display package of claim 1 wherein said first pair of cut lines are of unequal length and extend an equal distance on each side of said centrally located score line to form a panel of trapezoidal shape.

7. The display package of claim 6 wherein said secondary score lines conform to the non-parallel sides of said trapezoidal panel to form a tapered product enclosing and retaining intermediate means.

8. In combination, a paint brush and a substantially flat display package for said brush, said display package being prepared from a one-piece blank of paperboard or the like having a longitudinal dimension greater than its width dimension, a centrally located score line along its longitudinal dimension bisecting said blank into two equally sized portions and about which said equally sized portions are folded into face-to-face contact to enclose and retain said paint brush, the improvement comprising:

a. an aperture located in the top portion of said display package and oriented symmetrically about said centrally located score line which exposes the bristles of said paint brush to the touch of a consumer;

b. a window located in the bottom portion of said display package and oriented symmetrically about said centrally located score line which exposes the handle of said paint brush to the view of a consumer; and, c. an intermediate panel formed from said blank material between said aperture and window which encloses and grips a portion of said paint brush handle said panel including a plurality of secondary score lines in the longitudinal direction of said blank including at least one pair which connect the edges of said aperture and window and a plurality of additional score lines between said pair that are spaced from one another which enables said intermediate panel to grip and enclose handles of different size.

* * * * *